US005973252A

United States Patent [19]

Hildebrand

[11] Patent Number: 5,973,252

[45] Date of Patent: Oct. 26, 1999

[54] PITCH DETECTION AND INTONATION CORRECTION APPARATUS AND METHOD

[75] Inventor: Harold A. Hildebrand, Auburn, Calif.

[73] Assignee: Auburn Audio Technologies, Inc., Auburn, Calif.

[21] Appl. No.: 09/172,978

[22] Filed: Oct. 14, 1998

Related U.S. Application Data

[60] Provisional application No. 60/063,319, Oct. 27, 1997.

[51] Int. Cl.[6] ..... G10H 7/00

[52] U.S. Cl. ..... 84/603; 84/619; 84/645

[58] Field of Search ..... 84/603–605, 619, 84/645, 657

[56] References Cited

U.S. PATENT DOCUMENTS

| | | | |
|---|---|---|---|
| 4,217,808 | 8/1980 | Slepian et al. | 84/454 |
| 4,354,418 | 10/1982 | Moravec et al. | 84/454 |
| 4,523,506 | 6/1985 | Hollimon | 84/454 |
| 4,688,464 | 8/1987 | Gibson et al. | 84/454 |
| 5,231,671 | 7/1993 | Gibson et al. | 84/660 X |
| 5,349,130 | 9/1994 | Iwaooji | 84/616 |
| 5,567,901 | 10/1996 | Gibson et al. | 84/603 |
| 5,617,507 | 4/1997 | Lee et al. . | |

OTHER PUBLICATIONS

Lent, Keith, "An Efficient Method For Pitch Shiting Digitally Sampled Sounds", Computer Music Journal, Winter, 1989, pp. 65–71, vol. 13, No. 4.

*Primary Examiner*—Jeffrey W. Donels

*Attorney, Agent, or Firm*—Gary L. Bush, Esq.; Mayor, Day, Caldwell & Keeton, L.L.P.

[57] ABSTRACT

A device and method is disclosed to correct intonation errors and generate vibrato in solo instruments and vocal performances in real time. The device determines the pitch of a musical note produced by voice or instrument and shifts the pitch of that note to produce a very high quality, high fidelity output. The device includes a pitch detector that automatically recognizes the pitch of musical notes quickly. The detected pitch is then used as an input to a pitch corrector that converts the pitch of the input to an output with a desired pitch. The corrected musical note is then in tune with the pitch standard. The device and method employ a microprocessor that samples the signal from a musical instrument or voice at regular intervals using an analog-to-digital converter and then utilizes data derived from an auto-correlation function of the waveform to continuously determine the period of the waveform. The period of the waveform is then compared to a desired period or periods (such as found in a scale). The ratio of the waveform period and the desired period is computed to re-sample the waveform. This ratio is smoothed over time to remove instantaneous output pitch changes. The ratio is used to resample the input waveform. The resulting output waveform is processed through a digital-to-analog converter and output through audio interfaces.

38 Claims, 9 Drawing Sheets

A

30
Lmin1 < 1/2 OF ARRAY LENGTHS?
FALSE
31
Lmin = 8Lmin1
TRUE
32
FIND Lmin2 AS SECOND MINIMUM SATISFYING eps*Edown( ) ≥ Edown( )−2*Hdown( )
33
NONE FOUND
TRUE
RETURN
FALSE
34
USING THE NON−DOWNSAMPLED DATA, COMPUTE Lmin AS EITHER 8*Lmin1 OR 8*Lmin2; WHICHEVER BEST MINIMIZES E(Lmin)−2H(Lmin)
35
INITIALIZE E(i) AND H(i) ARRAYS i=1,...,N WITH Lmin AT N/2
36
DETECTION_MODE = FALSE
RETURN START
37
READ SAMPLE FROM A/D CONVERTER AND STORE AT INPUT_ADDR. INCREMENT INPUT_ADDR
38
DETECTION_MODE
TRUE
39
LPF, DOWNSAMPLE AND SET FLAG
FALSE
40
UPDATE H( ) AND E( ) USING EQUATIONS (4) AND (5)
41
ONCE EVERY 5TH INTERATION ?
FALSE
TRUE
42
PERFORM PITCH TRACKING. THIS RESULTS IN A NEW RESAMPLE_RATE2 VALUE
43
TRACKING FAILED?
FALSE
TRUE
44
DETECT_MODE = TRUE
RESAMPLE_RATE2 = 1
B

PITCH DETECTION AND INTONATION CORRECTION APPARATUS AND METHOD

REFERENCE TO PREVIOUS PROVISIONAL APPLICATION

This application is based upon and claims priority of U.S. provisional application 60/063,319, filed Oct. 27, 1997.

BACKGROUND OF THE INVENTION

1. Field of the Invention

This invention relates generally to electronic audio apparatus and in particular to apparatus and methods that determine the pitch of a musical note produced by voice or instrument which shift the pitch of that note toward a standard pitch.

2. Description of the Prior Art

Pitch is a quality of sound relating to the frequencies of the energy involved. Some sounds are very complex and don't involve energy of specific frequencies. A vocalist and the majority of individual instruments have the most clearly defined quality of pitch. The sound-generating mechanism of these sources is a vibrating element (vocal chords, a string, an air column, etc.). The sound that is generated consists of energy at a frequency (called the fundamental) and energy at frequencies that are integer multiples of the fundamental frequency (called harmonics). These sounds have a waveform (pressure as a function of time) that is periodic.

Voices or instruments are out of tune when their pitch is not sufficiently close to standard pitches expected by the listener, given the harmonic fabric and genre of the ensemble. When voices or instruments are out of tune, the emotional qualities of the performance are lost. Correcting intonation, that is, measuring the actual pitch of a note and changing the measured pitch to a standard, solves this problem and restores the performance.

The purpose of the invention is to correct intonation errors of vocals or other soloists in real time in studio and performance conditions. The invention is incorporated or embodied in an apparatus which can also introduce vibrato into the note, if desired by the user. The solo input sound is processed by the apparatus and by the method of the invention to produce an output of that same sound, except that it is in tune, possibly with vibrato added. The apparatus of the invention changes the instantaneous pitch and introduces no distortion in the output according to the method of the invention.

Determining the pitch of a sound is equivalent to determining the period of repetition of the waveform. A commonly used reference point for determining the period of the waveform is its zero crossings. Zero crossings are used, for example, in the electronic tuning aid disclosed by Hollimon (U.S. Pat. No. 4,523,506). For a simple sine wave, the period is easily determined as the time interval between successive zero crossings of the signal. More complex signals, however, can render the zero crossing approach as unsuitable for period detection, because multiple zero-crossings can occur.

Another common method of determining the period of the waveform is by using a peak detector circuit responsive to the time interval between peaks of the signal. Peak detection is used in the disclosure of Mercer (U.S. Pat. No. 4,273,023). As with zero crossing techniques, peak detection works well with a simple signal, such as a sine wave. When more complex signals are involved the accuracy of peak detection suffers, because multiple peaks of similar amplitude may occur.

To overcome some of the problems of determining pitch encountered by zero crossing and peak detection techniques, methods have been developed using the portion of the signal that crosses a set threshold as the reference point for determining the period. For example, in the method and apparatus disclosed by Slepian et al. (U.S. Pat. No. 4,217,808), an automatic gain control device adjusts the positive and negative excursions of the signal to selected levels. Positive and negative thresholds are then established, equal to a percentage of the maximum excursion levels. The period is essentially defined as the time between a first upward crossing of the positive threshold by the signal and a second upward crossing of the positive threshold, separated in time by a downward crossing of the negative threshold. Establishing a threshold includes no provision for ensuring that the reference point will correspond to high-slope regions of the signal. Thus, the signal may be relatively low in slope at the threshold crossing, making the exact time of occurrence difficult to determine.

Because the timing of the reference points used to determine the period of the signal may be difficult to precisely determine, another technique employs the computation of an average period from a plurality of period measurements over a longer period of time as a way of improving accuracy. For example, the note analyzer disclosed by Moravec et al. (U.S. Pat. No. 4,354,418), establishes separate period data counts for a number of cycles of the signal and outputs a period that is an average of the period data counts produced. This system requires a stable pitch over a large number of periods to accurately determine pitch. This situation is not typical of conditions needed for intonation correction, because the input pitch is not sufficiently stable.

Instead of using many period measurements over a long period of time, Gibson et al. (U.S. Pat. No. 4,688,464) adds more redundancy by making multiple estimates within a few cycles. The complexity of the measurements used by the Gibson method require many checks and balances to insure that false alarms and incorrectly identified pitches do not occur. In practice, this technique fails, yielding artifacts in the output.

All prior art techniques for determining the period of a waveform have a common failing: They all seek to determine some characteristic attribute(s) of the waveform and then determine the period of repetition of that attribute. All of these techniques eventually fail for the same reason: Noise in the waveform corrupts the computations or the waveform gradually changes shape, causing tracking to be lost, because an attribute being tracked is removed from the data.

Assuming that the input pitch is measured or is known, an apparatus and method can be provided to determine a pitch change from a standard and retune the input to that standard. A number of pitch shifting devices and techniques exist in the musical industry to do that. All of the prior methods are inadequate in achieving a high quality intonation correction. These techniques can be classified in two domains. The first are frequency domain methods which use Fast Fourier Transform (FFT) overlap-and-save algorithms. The second are time domain algorithms used by sampling synthesizers and harmony generators.

The FFT overlap-and-save algorithms are not high quality algorithms for pitch shifting for two reasons. First, they process sequences of data. Better quality pitch shifting occurs when longer sequences are used. The entire sequence can be shifted only by a constant pitch change. However, high quality intonation correction requires continuous changes in pitch. Hence there is a trade-off between continuity of shifting and sequence length. Second, input data windowing and subsequent window overlap cross-fade computations are non-ideal operations that introduce distortions in the output.

Existing time domain methods for pitch shifting in harmony generators work around the limitation of imprecise knowledge of the current period of the data. The method set forth in the article, Lent, K., "An Efficient Method for Pitch Shifting Digitally Sampled Sounds," *Computer Music Journal,* Volume 13, No.4, Winter, pp.65–71 (1989) (hereafter referred to as the Lent method) is a basic method used to resample data and maintain the shape of the spectral envelope. This method windows sections of the input data with windows one period in length and then recombines these windows with spacing of the new sampling period. The data is not resampled. Hence, a new fundamental period is defined, giving a perception of a new pitch. However, the amplitude spectra is augmented, resulting in unnatural sounds.

The windowing and window merging technique of the Lent method circumvents imprecise knowledge of the period of the data. Gibson et al. (U.S. Pat. No. 5,231,671) used the Lent method for pitch shifting in a harmony generator. Gibson uses a note's auto-correlation function as a one time—check for octave errors in initial estimates of the waveform period. Later, Gibson et al. (U.S. Pat. No. 5,567,901) added a data re-sampling step before the recombination step. However, this resampling does not completely compensate for shortcomings of the Lent method and is used more as a qualitative adjustment.

Sample based synthesizers adjust the pitch of output by resampling or changing the sample rate of data being played back from the memory of the device. Although a large number of techniques are used by these devices, none of them relate to this problem. Conceptually, these devices, using a technique called looping, store an infinitely long sequence of samples that are played back as output.

IDENTIFICATION OF OBJECTS OF THE INVENTION

A primary object of this invention is to provide an apparatus and method for pitch detection and pitch correction of a musical note produced by voice or instrument which overcomes the problems of prior art pitch detection and pitch correction apparatus and methods.

Another object of the invention is to provide an apparatus and method for pitch detection and pitch correction which introduces no distortion in the processed output signal of a musical note.

Another object of the invention is to determine pitch or frequency of a musical note or its inverse, the period of an instantaneous musical note, using its auto-correlation function.

Another object of the invention is to provide a pitch correction method and apparatus which processes a sequence of input samples in real time, by adding or dropping cycles of the musical note waveform as it is re-sampled.

SUMMARY OF THE INVENTION

The purpose of this invention is to provide an apparatus and method to correct intonation errors of vocals or other soloists in real time in studio and performance conditions. The solo input is processed by the invention, and the output of the apparatus is that same sound, except that it is in tune. A vibrato may also be introduced into the output. The apparatus changes the instantaneous pitch and introduces no distortion in the output.

The method of the invention starts with the step of inputting an audio signal from standard line level, or microphone input to an A/D converter. The resulting digital data is then input to a microprocessor. The data is processed according to the intonation correction function as described below. Because some options exist for the user to choose, a LCD, control knobs and status lights allow the user to view the status and control the device. After processing, the data is passed to D/A converters and then to standard analog (or digital) audio interfaces.

The processing of the data has two modes: the detection mode and the correction mode. Detection mode processing occurs when the pitch of the data is unknown. Correction mode occurs when the pitch is known.

In the pitch detection mode, the pitch detection is virtually instantaneous. The device can detect the repetition in a periodic sound within a few cycles. This usually occurs before the sound has sufficient amplitude to be heard.

The method and apparatus of this invention provides the ultimate redundancy in measuring pitch, or its inverse, the period of the waveform: it uses all samples in the waveform, by continuously comparing each cycle with the previous cycle. The method successfully processes waveshapes of arbitrary complexity. Its high degree of redundancy minimizes the effect of added noise and allows the waveform to gradually change shape. The method and apparatus of the invention do not rely on any one attribute of the data, and is, consequently, much more accurate and robust in its results. At the heart of the method and apparatus of the invention are formulae which are derived from the auto-correlation function of the data.

The auto-correlation of a sequence of data, $x_j$, having a period of repetition, L, is $$\Phi_L(n) = \sum_{j=0}^{L} x_j x_{j-n}$$

The auto-correlation function of periodic waveforms is also periodic. Furthermore, the value of the auto-correlation function at a lag, n, equal to one period is equal to its value at zero lag. Moreover, the value of the auto-correlation at any lag only approaches the value at zero lag if that lag equals a period of repetition of the data. It is the computation and tracking of values at these lags that creates the robust qualities of the current invention.

In practice, the auto-correlation function has not been used to search for periodicity or track existing periods, because it requires a high level of computation to generate. The method and apparatus of the invention incorporate various techniques to make the auto-correlation computation more efficient.

Specifically, at time, i, given a sequence of sampled data, $\{x_j\}$, of a waveform of period L for j=0, . . . , i, the auto-correlation as a function of lag n can be expressed, $$\Phi_{i,L}(n) = \sum_{j=i-L-1}^{i} x_j x_{j-n} \tag{1}$$

To reduce the computations involved, "E" and "H" functions are evaluated:

$$E_i(L) = \Phi_{i,2L}(0) = \sum_{j=0}^{2L} x_j^2 \tag{2}$$

The function $E_i(L)$ is so named because it is the accumulated energy of the $$H_i(L) = \Phi_{i,L}(L) = \sum_{j=0}^{L} x_j x_{j-L} \tag{3}$$

waveform over two periods, 2L. The lag argument, n, is not present. In other words, the auto-correlation value, $E_i(L)$, is only computed at zero lag, and with the (known) period of repetition, L, ($H_i(L)$). At time, i, given a sequence of data, $\{x_j\}$, for j=0, . . . , i, these equations can be expressed:

$$E_i(L)=E_{i-1}(L)+x_i^2-x_{i-2L}^2 \tag{4}$$

$$H_i(L)=H_{i-1}(L)+x_i x_{i-L}-x_{i-L}x_{i-2L} \tag{5}$$

In other words, for each prospective lag, L, four multiple-adds must be computed. It can be shown (unpublished proof) that $$E_i(L) \geqq 2H_i(L)$$

and that $E_i(L)$ is nearly equal to $2H_i(L)$ only at values of L that are periods of repetition of the data. Because the scaling of the data, $\{x_j\}$, is unknown, the term "nearly" must be interpreted relative to the energy of the signal. This results in a threshold test for detecting periodicity:

$$E_i(L)-2H_i(L) \leqq eps\ E_i(L) \tag{6}$$

where "eps" is a small number. When this condition is satisfied by varying the value of L, then L is a period of repetition of the data.

Having broadly described the principle of the invention the method of the invention can be briefly described. There are two modes of operation termed the detection mode and the correction mode. The detection mode operates by first reducing the sample rate by a factor of eight using an anti-alias filter followed by a one out of eight data resampling. Equations (4), (5) and (6) are then computed for values of L ranging from 2 to 110. For $\{x_j\}$ sampled at 44100 Hz, this gives a frequency range of 2756 Hz to 50.1 Hz., respectively, of detectable frequencies. The low frequency of 50.1 Hz is much lower than the voice and lower than most bass instruments. The high frequency of 2756 Hz is significantly higher that a soprano's "high C", which is 1046 Hz.

An additional test is desirable. Specifically, some vowels in the human voice have very little energy at the fundamental frequency. As a result the method described above detects the first harmonic to determine the period of the data. In order to be sure that a harmonic frequency is not being measured, the equation (6) test is used on the L and 2L lags of the non-downsampled data, $\{x_j\}$, to decide the actual fundamental frequency.

The correction mode must track changes in pitch. This is done by computing equations (4) and (5) over a small range of L values around the detected pitch. As the input pitch shifts, the minimum value of equation (6) shifts, and the range of L values is shifted accordingly.

The input waveform's period is then used to retune the input waveform. To achieve this, several different methods are provided to specify a desired period. A first method determines the desired period as being the period of a note from a musical scale that is closest to the input period. A second method is to input the desired period from a MIDI interface. (MIDI is a standard data interface found on electronic musical instruments.) MIDI transmissions contain data to turn specific notes on and off. The currently "on" note can be used as the desired pitch. The desired pitch can also be modified by using the MIDI Pitch Bend controller data.

The method of this invention takes full advantage of precisely determining knowledge of the period of the data. The data is resampled at a new sample rate proportional to the desired change in pitch. In the case of making the pitch sharper (larger sample spacing than the input data), the output data pointer will occasionally move ahead of the input data pointer, in which case exactly one cycle period will be subtracted from the output pointer. This allows a cycle of data to be repeated. In the case of making the pitch flatter (smaller sample spacing than the input data), the output data pointer will occasionally fall significantly behind the input data pointer, in which case exactly one cycle period will be added to the output pointer. This causes a cycle of data to be dropped from the output. This resampling approach generates extremely high quality output.

The accuracy of pitch correction in the invention is exceptional. In the worst case, a continuously varying tone can be corrected (under the control of the apparatus by the user) to within an error of at most one cycle in 80 seconds. This accuracy is equivalent to the accuracy of the clocks which control music studio functions. The output pitch is detected and corrected without artifacts in a seamless and continuous fashion.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which.

DESCRIPTION OF THE PREFERRED EMBODIMENT OF THE INVENTION

The pitch detection mode and the pitch correction mode of the device and method of the invention are described generally in the SUMMARY OF THE INVENTION presented above. The pitch detection is achieved by processing sampled music notes or sounds according to auto-correlation function techniques, preferably by references to equations (4), (5) and (6) of the summary. After determining the period of the input waveform, the pitch correction mode operates by changing the frequency (that is period) toward a desired frequency (period). A detailed description of the invention, by way of a logic step diagram, suitable for programming a digital computer follows.

Figure 1:
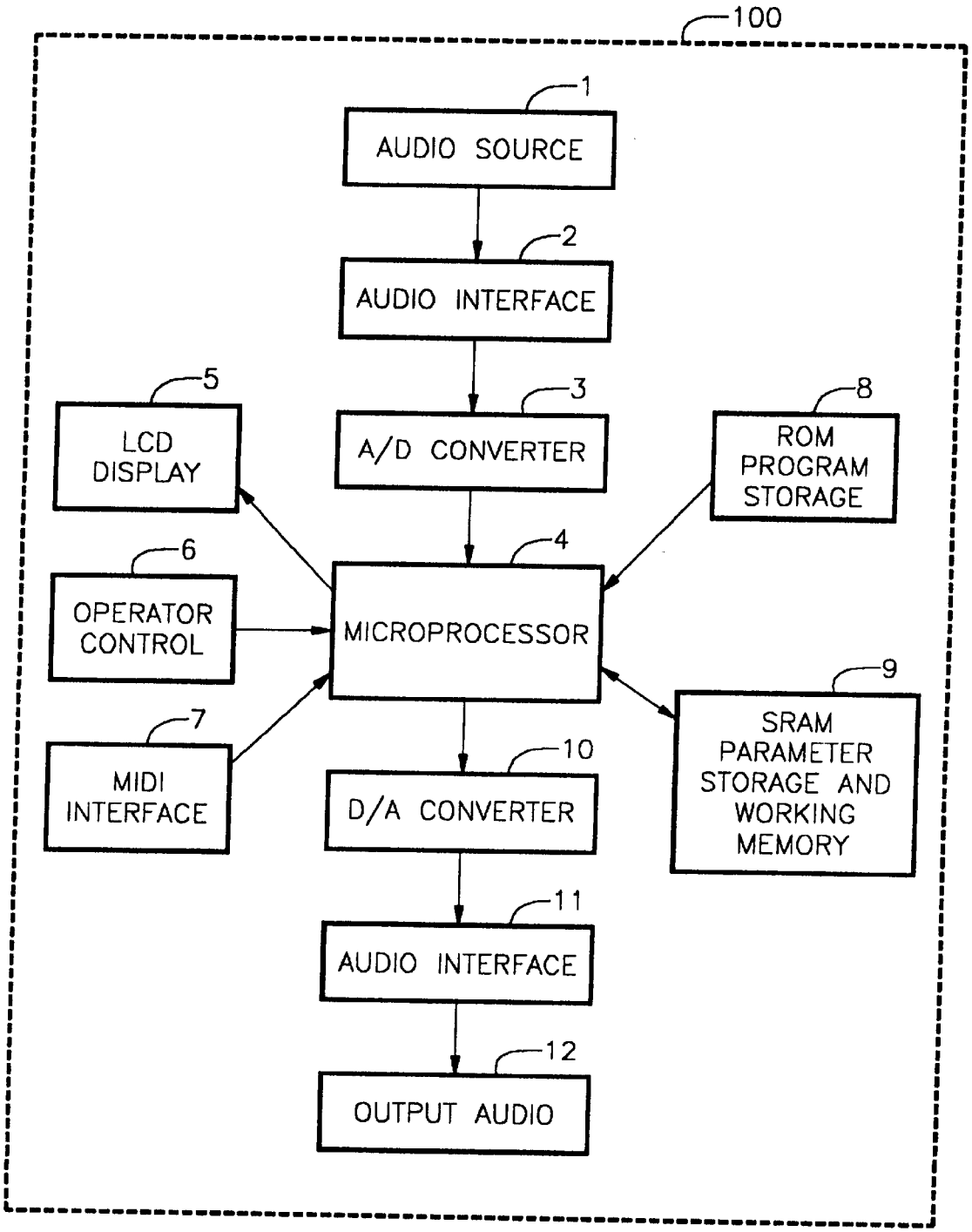
FIG. 1 is a system block diagram of the pitch detection and correction apparatus of the invention showing input sound interfaces, output sound interfaces, operator control interfaces and a microprocessor and other elements of the apparatus.

Referring now to FIG. 1, the basic function of the pitch detection and intonation correction device 100 is to input sound, process the sound to correct for pitch errors, and output a pitch corrected ouput sound. The audio source 1 is an analog electrical signal, for example, a voltage signal that is proportional to sound pressure in air. Such a voltage signal can be generated by a microphone or by other audio equipment. A number of audio source standards are in common use today. These include low voltage microphone outputs and line voltage audio equipment outputs. Wiring standards are typically two wire unbalanced line (¼ inch plug) and three wire balanced line (XLR plug). The audio interface 2 depends on the kind of input. Microphone input requires pre-amplification. Balanced inputs (XLR plugs) require common mode rejection circuits.

Ultimately, the analog input signal that is applied to the A/D converter 3 is a single voltage referenced to the ground of the device. The A/D converter 3 includes a low pass anti-alias filter, a clock source and an A/D conversion chip. The clock source defines the sample rate. Preferably the sample rate is a conventional 44,100 samples per second. Slower speeds will reduce fidelity, and faster speeds will deplete computational resources without audible quality improvement. It is preferred that the precision of the A/D converter be 16 bits. To achieve 16 bit conversion, a nominal 18 bit converter is preferably used. Sixteen bit accuracy is required to maintain precision in the computations in the presence of the highly variable dynamic range typical of vocal music sung into a microphone.

The microprocessor 4 receives the A/D output from the converter 3. The interface between the A/D converter 3 and the microprocessor 4 is selected from any of a number of serial I/O standards in common use today. When a sample has been received, the microprocessor 4 issues an interrupt, causing the sequencer of the microprocessor to begin execution of interrupt processing steps described below.

The microprocessor 4 also is interfaced with a number of other devices. The LCD display 5 allows the operator to view the status of the device 100 and control parameter entries into the device. The operator controls 6 includes buttons and encoder dials which enable the user to control parameters and set flags that affect the processing.

The MIDI (Musical Instrument Digital Interface) 7 is a common wiring and signaling standard used in the music industry. It uses a serial transmission protocol to communicate messages that tell synthesizers to turn on and off particular notes in the musical scale. The note on and off messages are used by the device 100 as a device to specify the pitch to which the output is to be tuned. MIDI interface 7 also communicates various control information, including pitch bend, which is also used by the device 100 to specify the pitch to which the output is to be tuned.

The ROM program store 8 is used to store the sequence of program instructions during power-off. The SRAM parameter storage and working memory 9 provides working memory for the microprocessor as well as battery backup storage of parameters set by the user. In this way, when the unit is powered on, the settings of the device revert to those in use when the device was powered off.

The D/A converter 10 processes 16 bit, 44,100 sample per second pitch corrected output data from the microprocessor and converts it to a continuous analog signal. The audio interface 11 converts the analog signal to balanced or unbalanced line output 12 typically found in audio equipment.

Figure 2:
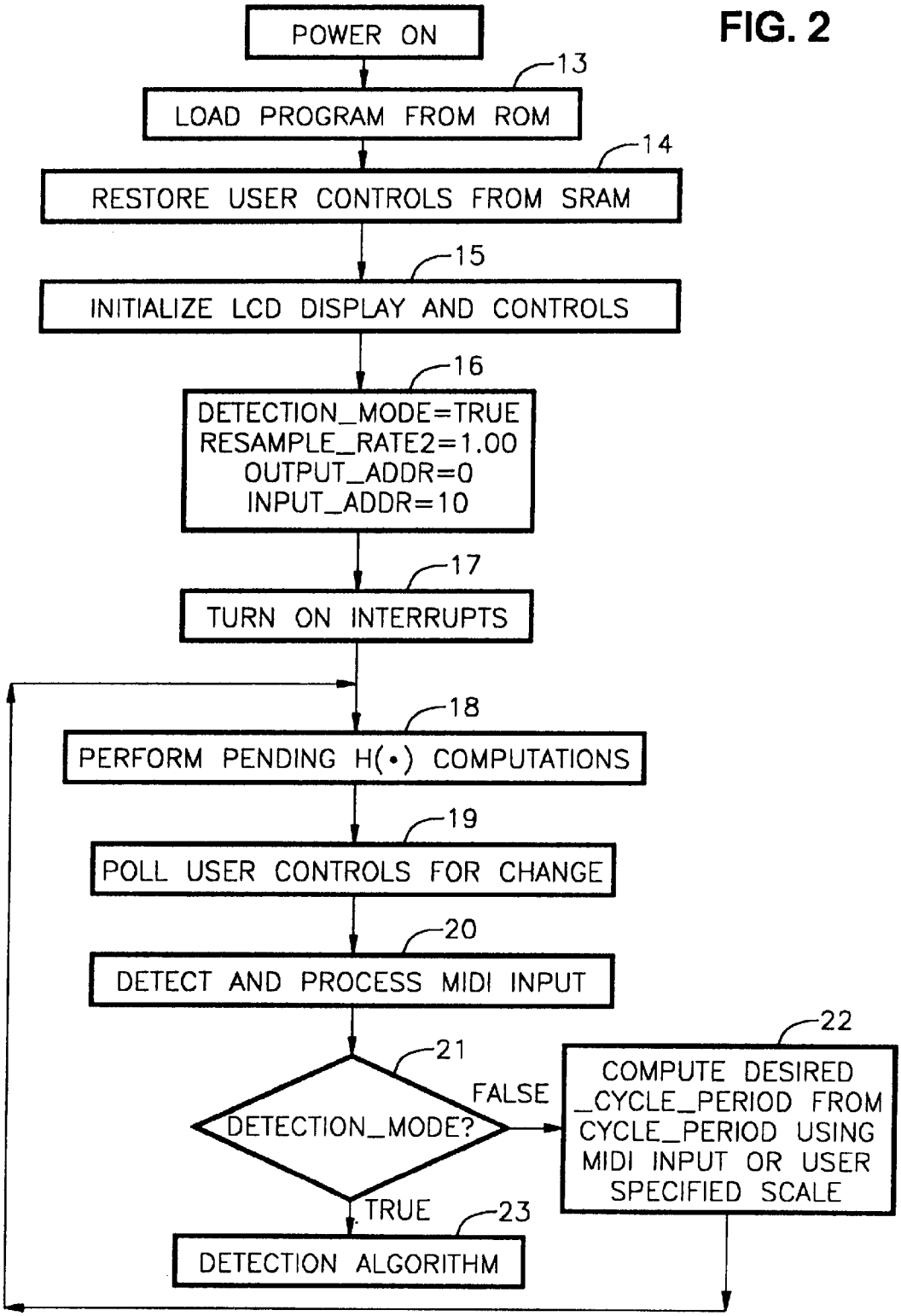
FIG. 2 is a flow chart showing the sequence of execution of non-interrupt processing of the microprocessor.

Referring now to FIG. 2, the sequence of execution of non-interrupt processing of the microprocessor 4 is shown. After the power is turned on, the microprocessor 4 performs a bootstrap process 13 to load its program from ROM 8 (Read Only Memory). This step is required because the high speed processors used in the invention (preferably a Motorola 56000 class DSP chip) cannot efficiently process instructions from ROM 8 due to the slow speed of the ROM. Instead, the instructions are read from ROM 8 and stored in the SRAM (Static Random Access Memory) 9 for processing. After this bootstrap procedure, control is passed to the loaded code to continue processing.

Next, the microprocessor 4 performs in logic step 14 any processing necessary to restore user controls from SRAM 9 that has been saved using non-volatile battery powered SRAM.

Next, the microprocessor 4 initializes the LCD 5 (Liquid Crystal Display) and user controls in step 15 as well as performing any other initialization required by parts of the system. Certain parameters of the algorithm are initialized in step 16. Setting the Detection mode parameter to true indicates that (1) the input pitch is not known, (2) no pitch correction can occur, and (3) the pitch detection algorithm must be used. Setting the Resample_Rate2 to the value 1.00 allows the pitch correction algorithm to process the data with no pitch correction. Output_addr and Input_addr are indexes to the same buffer in which input samples are stored. For a clear and concise description the examples of processing shown below, assume that this buffer is infinite in length. In actual preferred practice, a circular buffer is used. A circular buffer requires modifications to the algorithms described which are obvious to one of ordinary skill in this art and need no further explanation here.

Finally, the interrupts are turned on in logic step 17. Hence forth, when an audio sample is received by the microprocessor, the sequencer of the microprocessor will begin execution of interrupt processing code described below.

The remainder of the code described in FIG. 2 represents a loop that repeats indefinitely, as long as the device 100 remains powered on. The first logic step 18 in this loop is to perform any pending H(.) computations. This computation is performed using equation (3) described above. The requirement for this computation of pending, uncompleted H(.) computations is generated by the pitch tracking algorithm that is executed during interrupts. The computation is too lengthy to occur during the $1/44100$ second time slot of one interrupt. Instead, a flag is set and the "i" and "L" parameters in equations (4) and (5) are stored during interrupts. This is detected at logic step 18 where the computation is performed.

The user controls are polled for any changes in logic step 19. This code detects button presses and encoder turns, manages the LCD, and stores any parameter changes in memory for subsequent use by the algorithm.

A MIDI input is detected and processed in logic step 20 resulting in the current state of the MIDI input being stored in memory. Specifically, the most recent note is turned on (if any) and the current state of the pitch bend are maintained in memory.

The logic Boolean, Detection_mode, is tested in logic step 21. If true, the detection algorithm of logic step 23 (discussed below) is executed, otherwise the desired_Cycle_period is computed at logic step 22. The input to this computation is Cycle_period. Cycle_period is the floating point length in samples of the period of the input data. It is computed by the pitch tracking algorithm during interrupts. The desired_Cycle_period is the cycle period which makes the pitch in tune. The criterion for what is in tune is set by the user through the interface to be either the current MIDI input note, or the note in a musical scale closest to the Cycle_period.

Figure 3A:
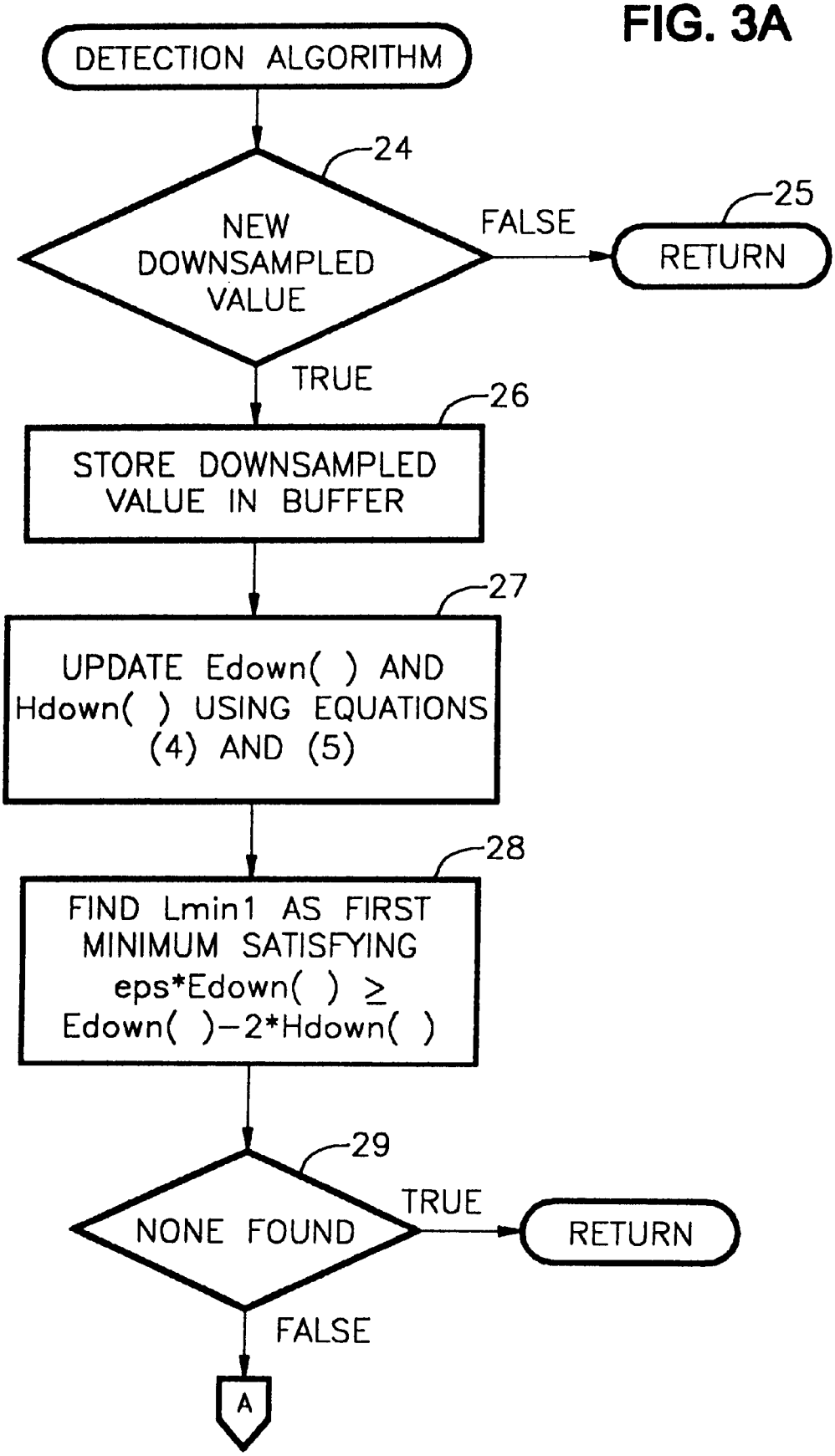
FIGS. 3A an 3B together provide a flow chart showing the sequence of execution which occurs as part of the non-interrupt processing, particularly describing the method according to the invention that processes incoming data and detects the pitch in that data.
Figure 3B:
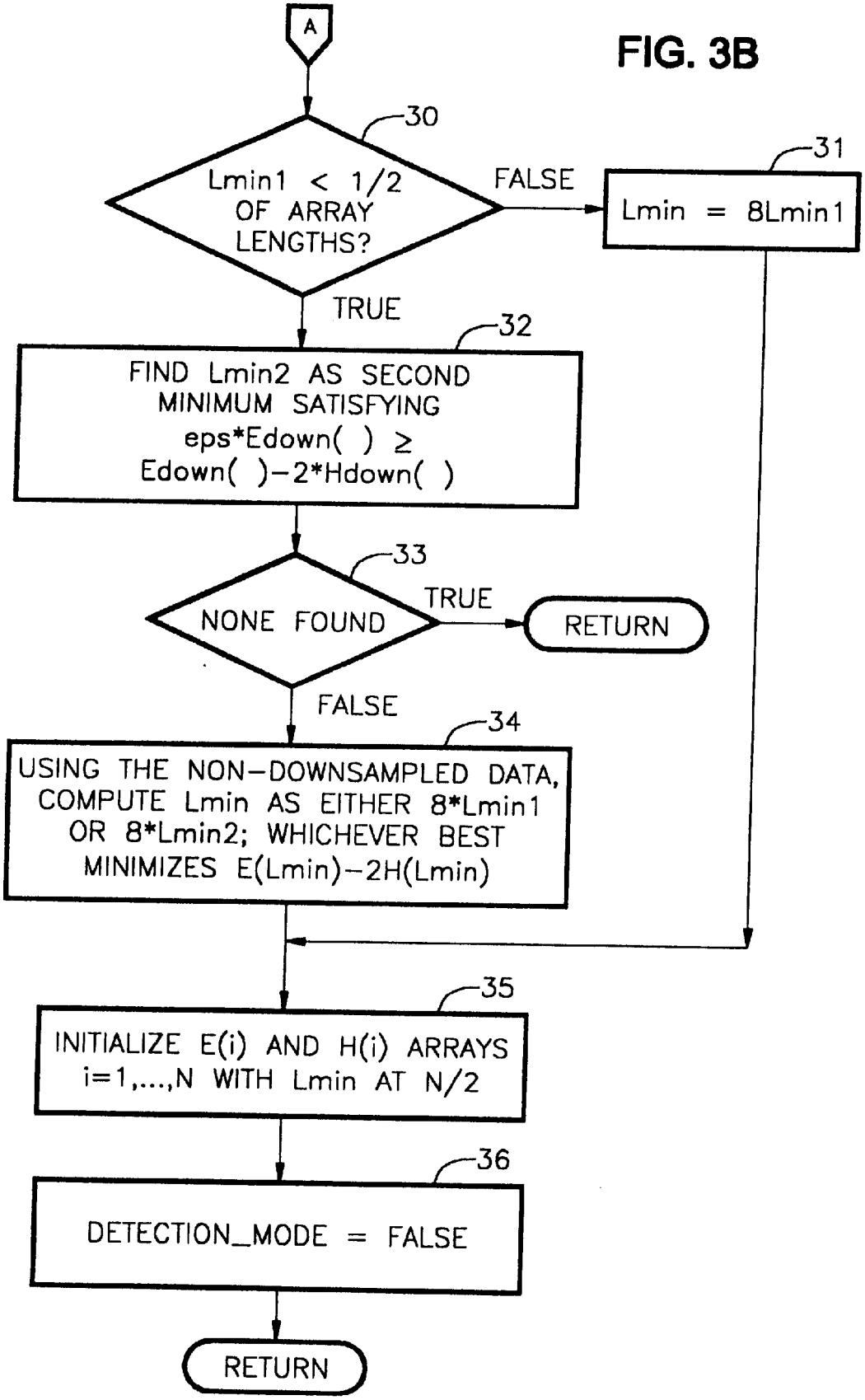

Referring now to FIGS. 3A and 3B, the detection algorithm of logic step 23 (FIG. 2) is illustrated. The detection algorithm 23 processes incoming data and detects the pitch in that data. It will be described below, in the discussion of the interrupt processing, that this incoming data is derived from the 44,100 KHz A/D converter output 3 (FIG. 1) by processing with an anti-alias filter and 8-to-1 downsampling. Because the algorithm in FIGS. 3A and 3B is not in the interrupt processing sequence, and because it processes every 8th sample, it has more time to complete its computations. In FIG. 3A, the first test of logic step 24 checks the availability of a new sample. This is done by checking a flag set in the interrupt handler (see logic step 39 below). If none is available, the algorithm in logic step 25 returns to the other polled processing. Otherwise, the sample is stored in a downsampled buffer in logic step 26. Next, the arrays Edown(L) and Hdown(L) are updated in logic step 27 using equations (4) and (5), respectively, for values of L ranging from 2 to 110. The symbol $x_i$ represents the most recent sample stored in the downsampled buffer of logic step 26 and other values of $x_j$ are older values taken from the buffer.

Pitch detection takes place in logic step 28. Specifically, Lmin1 is found as the first index from 2 to 110 of the arrays Edown( ) and Hdown( ) such that a local minimum satisfying equation (6) is found. The parameter "eps" is a small value in the range between 0.0 to 0.40 that can be specified by the user. Smaller values of "eps" place a more stringent requirement that the two cycles of the waveform thus found are of similar shape. If no such Lmin1 is found, then logic step 29 specifies a return.

If Lmin1 is found, then there is the possibility that the first harmonic has been mistakenly identified. This occurs because in some sounds, the fundamental (one-half the frequency of the first harmonic) is very weak. Also, higher order harmonics may not be present because they have been removed by the 8-to-1 downsample anti-aliasing filter. In singing, the fundamental is absent with certain vowels in some singers. Pitch tracking of the first harmonic on the non-downsampled data will not be successful. Hence the pitch detection algorithm must test for the presence of the fundamental. In FIG. 3B, the test of logic step 30 determines if the fundamental will be high enough in frequency to be detected. If it is not (the false condition) then Lmin is computed in logic step 31 as 8 times Lmin1. Lmin is the approximate period of the 44100 KHz data.

If the fundamental is high enough in frequency to be detected, control is passed from logic step 30 to logic step 32 where Lmin2 is found as the first index from Lmin1 to 110 of the arrays Edown( ) and Hdown( ) such that a local minimum satisfying equation (6) is found. If no such Lmin2 is found, then a return is made from logic step 33.

If Lmin2 is found, logic step 33 passes control to logic step 34 for a determination whether Lmin is set to 8*Lmin1 or 8*Lmin2. The choice is made according to which best represents the period of the data. This is done by computing E( )−2H( ) from the non-downsampled data for each possibility and choosing the Lmin which gives the smallest value. Lmin is now the approximate period of the 44,100 KHz data.

The arrays E( ) and H( ) are computed by the same formula as Edown( ) and Hdown( ), except they are computed from the 44,100 KHz data. Equations (4) and (5) allow for L values from 16 to 880 on the 44,100 KHz data. Also, E( ) and H( ) must be updated eight times more frequently. The resulting computing load is 64 times greater than the downsampled case and is beyond the capacity of conventional microprocessors. Consequently, the E( ) and H( ) arrays are computed for a range of values around the index representing the period of the data. Equations (4) and (5) are used during interrupts to update existing values of E( ) and H( ). Hence, values of E( ) and H( ) are initialized at logic step 35. The preferred value of N is 8. Lmin is set to N/2, as shown in logic step 35. Also, EH_Offset is set to Lmin−N/2+1, and defines the L value for equations (4) and (5) for E(1) and H(1).

Finally, the Boolean Detection_mode of logic step 36 is set to false. This causes pitch tracking to occur during interrupts.

Figure 4A:
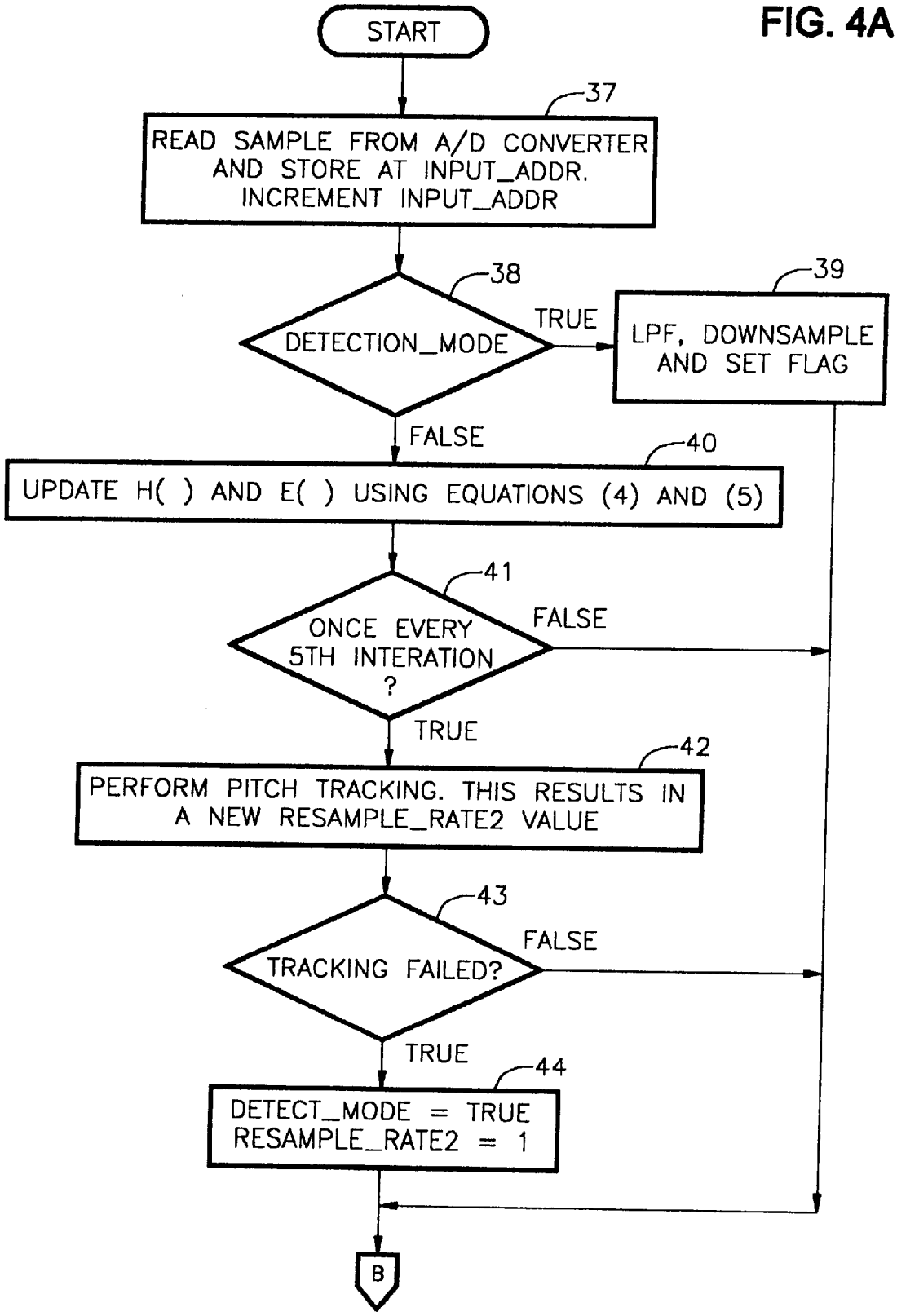
FIGS. 4A and 4B together provide a flow chart showing the sequence of execution which occurs each time an interrupt occurs indicating the availability of a new sample in the A/D converter.
Figure 4B:
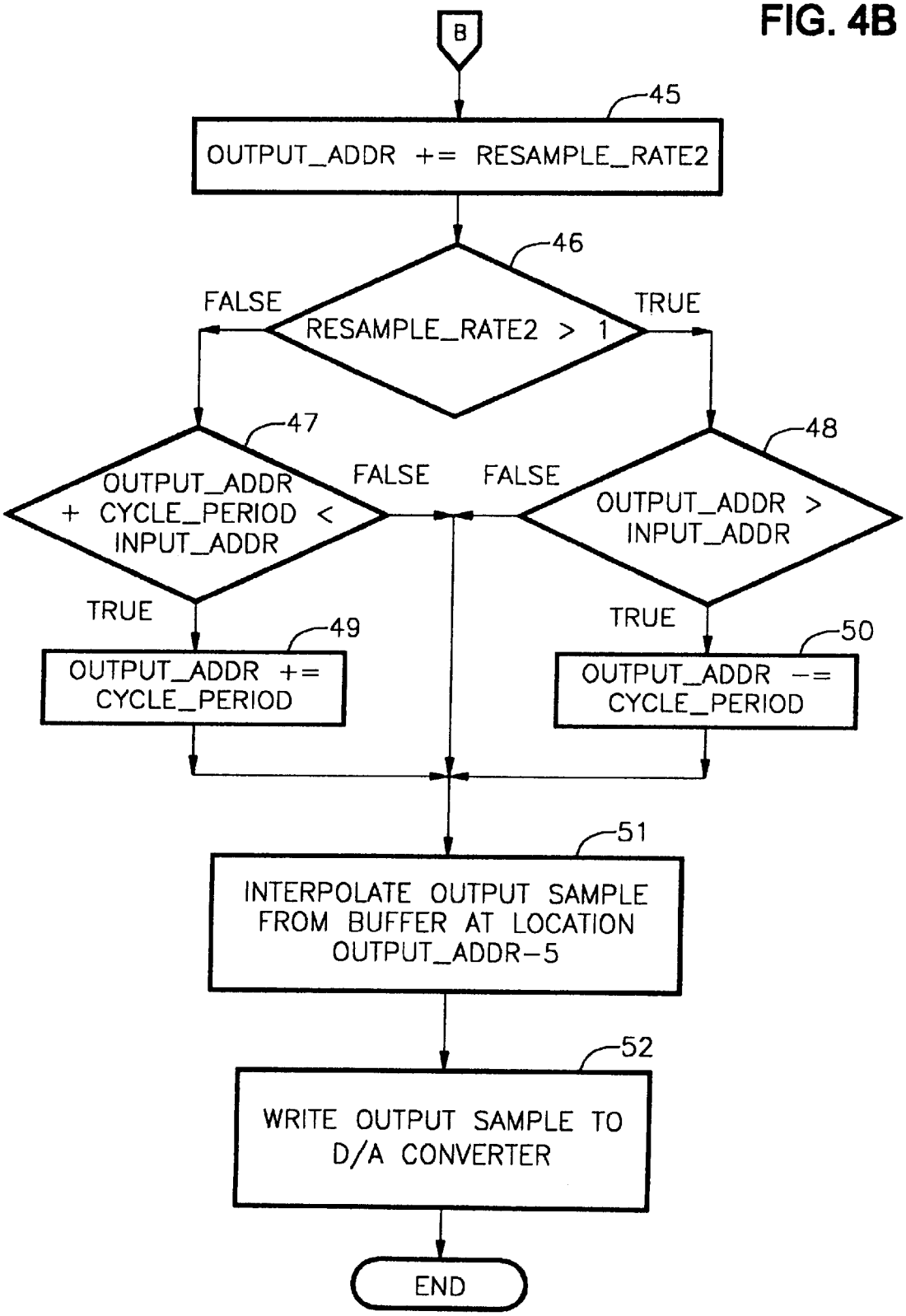

Referring now to FIGS. 4A and 4B, a logic flow chart is presented which shows the sequence of execution which occurs each time an interrupt occurs indicating the availability of a new sample in the A/D converter 3. In FIG. 4A, the audio sample is read in logic step 37 from the A/D converter 3 and stored in the input buffer at address Input_addr. The Input_addr is incremented by adding a one to it.

If the device is in detection mode, logic step control is passed to logic step 39 for 8-1 downsampling. Downsampling consists of a low pass anti-alias filter (LPF), choosing every 8th sample (downsampling) and setting a flag. This flag is detected during the polling process in the detection algorithm at logic step 24, where the downsampled value is processed. After downsampling in logic step 39, the interrupt processing proceeds to logic step 45, where the output data is re-sampled from the input data. While the Detection_mode is true, the Resample_Rate2 is equal to 1., resulting in no change of output pitch.

If the device is not in detection mode as determined in logic step 38, then the H( ) and E( ) arrays are updated in logic step 40 using equations (4) and (5). The indices of E( ) and H( ) range from 1 to N, representing equation (4) and (5) L values equal to EH_Offset through EH_Offset+N−1, respectively.

Next, the pitch tracking computations of logic step 42 will be performed every 5th iteration as indicated by logic step 41. This allows more time for the computations involved without detracting from the quality of the result. The pitch tracking computations of logic step 42 are described in detail in FIGS. 5A and 5B. The results of that computation are questioned in logic step 43 as to whether pitch tracking failed. If there has been success, control is transferred to step 45. If pitch tracking has failed, logic step 44 sets Resample_Rate2 to 1. and Detection_mode to true.

Referring now to FIG. 4B, Resample_Rate2 is a floating point value close to 1. that is used to increment Output_addr in logic step 45. Output_addr is the floating point buffer address from which the output sample will be interpolated. A Resample_Rate2 value of 1. results in no pitch change. A Resample_Rate2 value greater than 1. results in fewer samples per cycle, thus raising the pitch. A value less than 1. results in more samples per cycle, thus lowering the pitch.

Logic block 46 tests if Resample_Rate2 is greater than 1., in which case the output pointer, Output_addr, may overrun the input pointer, Input_addr. Overrun is detected in logic step 48 and control is passed to logic step 50 where exactly one floating point cycle period, Cycle_period, is subtracted from Output_addr, thereby preventing the overrun. If Resample_Rate2 is less than 1., the output pointer, Output_addr, may underrun (fall significantly behind) the input pointer, Input_addr. Underrun is detected in logic step 47 and control is passed to logic step 49 where exactly one floating point cycle period, Cycle_period, is added to Output_addr, thereby preventing the underrun.

Logic step 51 interpolates the output sample from the input buffer at address Output_addr−5. Any number of standard interpolation methods can be used. A preferred mode choice depends on the amount of available processing time. Subtracting five allows interpolation methods to succeed when the value of Output_addr is close to Input_addr. Finally, the interpolated value is written to the D/A converter 52 and the interrupt processing is completed.

Figure 5A:
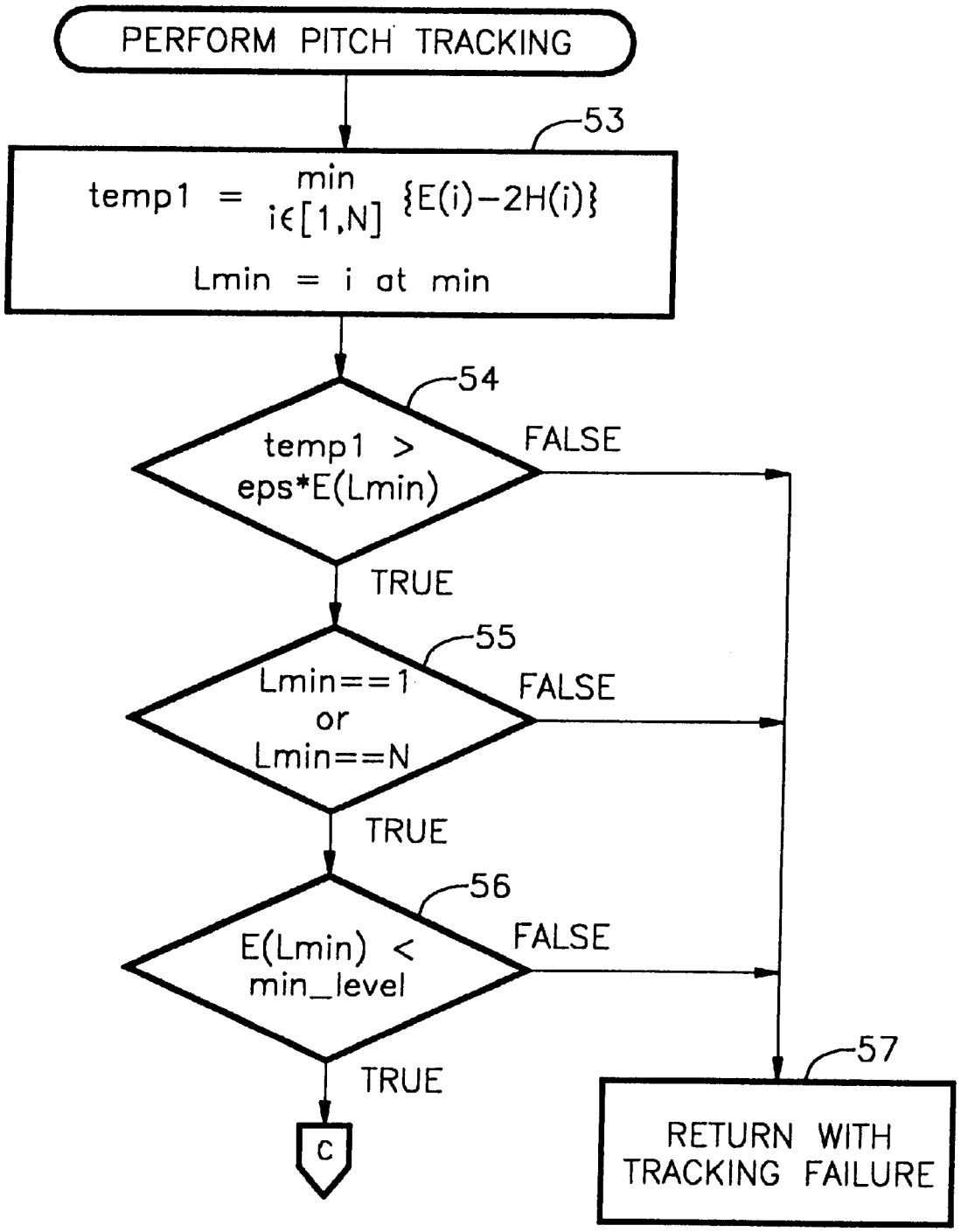
FIGS. 5A, 5B and 5C together provide a flow chart showing the sequence of execution that is additional detail in the interrupt processing, particularly showing the method of tracking changes in pitch of the sound.
Figure 5B:
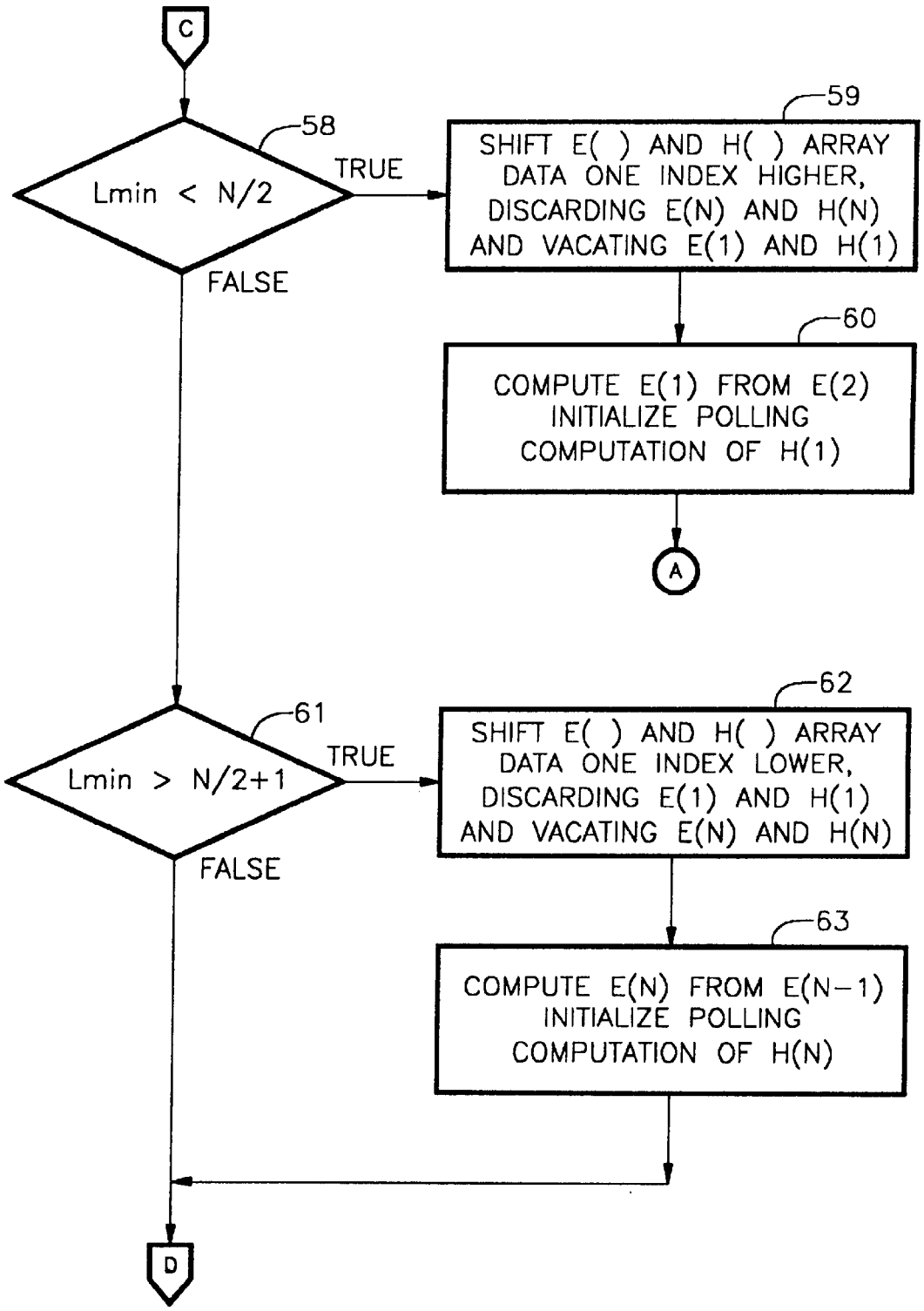
Figure 5C:
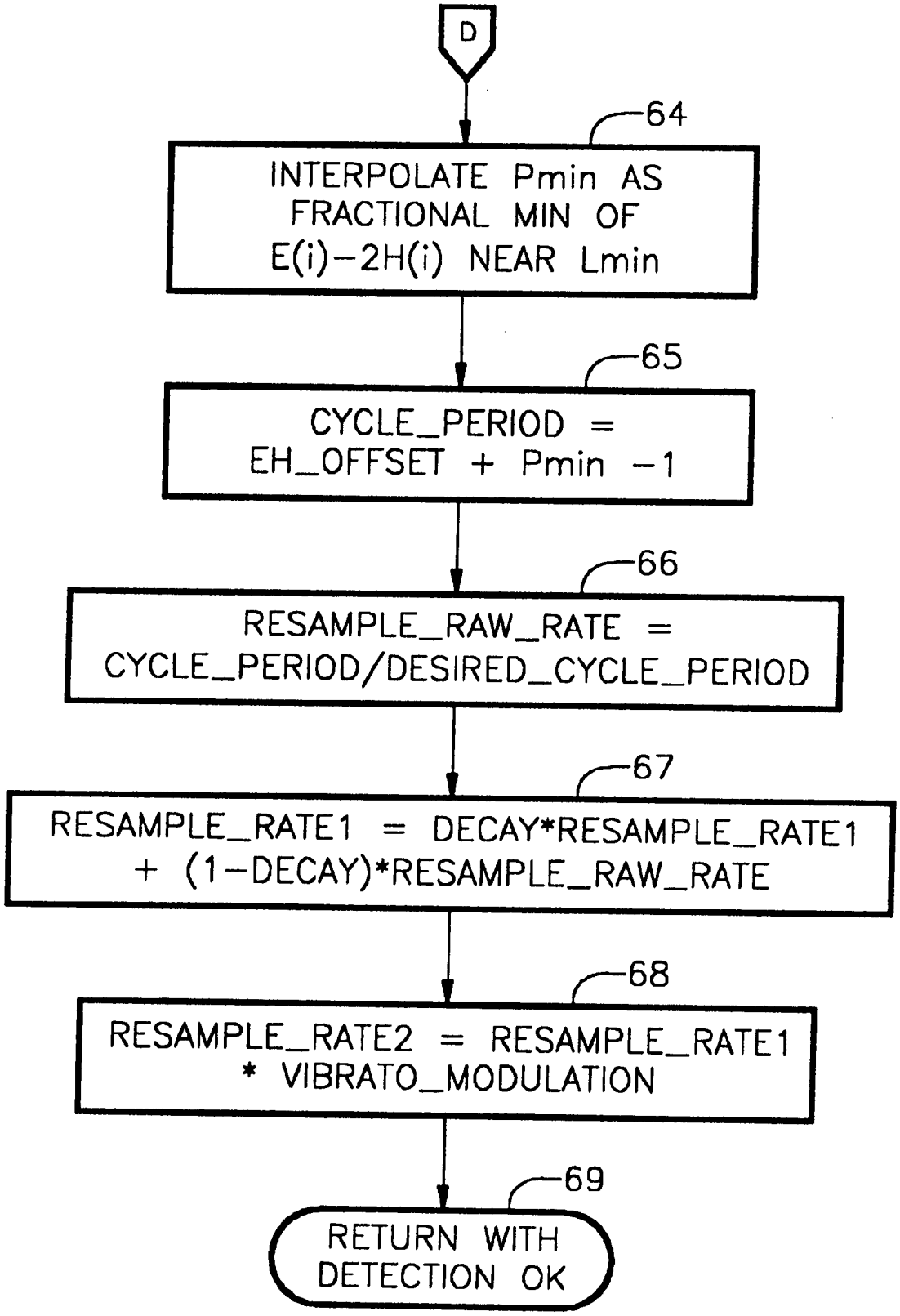

Referring now to FIGS. 5A, 5B and 5C, the pitch tracking computations mentioned above by reference to logic step 42 are described in detail. First, in FIG. 5A, in logic step 53 the values for E(i)−2H(i) are computed for index i from 1 to N. The smallest of these values is stored in temp1 and the index "i" at which the smallest value was found, is stored in Lmin. A test of logic step 54 then determines if the minimum stored in temp1 satisfies equation (6). If it does not, then control is passed to logic step 57, where a return is made indicating a tracking failure.

If the pitch changes too rapidly, then the test at logic step 55 will pass control to logic step 57, where a return is made indicating a tracking failure. If the energy in the current signal is too low, then the test at logic step 56 will pass control to logic step 57, where a return is made indicating a tracking failure.

Referring now to FIG. 5B, as indicated above, the E( ) and H( ) arrays are computed for a range of values around the index representing the period of the data. If the period of the data shifts sufficiently to a smaller or larger index, the range of E( ) and H( ) must be shifted in kind. This is shown in FIG. 5B. Specifically, if Lmin is less than N/2, then the test of logic step 58 transfers control to logic step 59 where the E( ) and H( ) arrays are shifted one index higher, discarding the old values of E(N) and H(N) and requiring new values to be computed for E(1) and H(1). The variable EH_Offset is decremented by one. E(1) is computed from E(2) in logic step 60 by subtracting a single term derived from equation (2). H(1) must be computed from equation (3) with L equal to EH_Offset. Because this computation is lengthy, it is not performed here. Rather, parameters describing this computation are stored and a flag is set such that the computation is performed in the polling algorithm as shown in FIG. 2, logic step 18.

Similarly, if Lmin is greater than N/2+1, then the test of logic step 61 transfers control to logic step 62 where the E( ) and H( ) arrays are shifted one index lower, discarding the old values of E(1) and H(1) and requiring new values to be computed for E(N) and H(N). The variable EH_Offset is incremented by one. The function E(N) is computed from E(N−1) in logic step 63 by adding a single term derived from equation (2). The function H(N) must be computed from equation (3) with L equal to EH_Offset+N −1. Because this computation is lengthy, it is not performed here. Rather, parameters describing this computation are stored and a flag is set such that the computation is performed in the polling algorithm as shown in FIG. 2, block 18.

Referring now to FIG. 5C, at this point in the computations, Lmin is an integer pointer to the minimum of E( )−2 H( ), indicating the period of the data. However, this value is not sufficiently accurate for pitch correction computations. Instead, Pmin is computed in logic step 64 as a floating point version of Lmin by interpolation of the minimum of E( )−H( ) near index Lmin. The preferred approach for this interpolation is to use the three points closest to Lmin and perform a quadratic fit interpolation.

The floating point period (samples per cycle) is computed at logic step 65 as EH_Offset+Pmin−1 and stored in Cycle_period. The variable EH_Offset is the samples per cycle represented by E(1) and H(1). The variable Resample_Raw_Rate is computed at logic step 66 by dividing Cycle_period (just computed in logic step 65) by desired_Cycle_period. The value, desired_Cycle_period, is computed as show in FIG. 2, logic step 22.

If Resample_Raw_Rate were used to resample the data, the pitch of the output would be precisely in tune with the desired pitch as determined in logic step 22. Because the desired pitch will change instantaneously to a different scale note or a different MIDI note, the output pitch would also change instantaneously. This is objectionable when the human voice is being processed, because the voice does not instantly change pitch. The computation for Resample_Rate1 of logic step 67 smooths out Resample_Raw_Rate, alleviating this problem. The variable, Decay, is between zero and one and is set by the user. A value of zero cause Resample_Rate1 to equal Resample_Raw_Rate, giving instantaneous pitch changes. A value close to one causes a lot of smoothing, making pitch changes gradual.

In some cases it may be desirable to introduce vibrato into a note. This is done in logic step 68 by modulating Resample_Rate1 by a coefficient, Vibrato_modulation, that changes over time to make the output alternately sharp and flat. The vibrato depth, rate and onset delay is controlled by user input. Finally, logic step 69 returns control back to the interrupt processing routine as shown in FIG. 4A, block 42.

While preferred embodiments of the present invention have been illustrated and/or described in some detail, modifications and adaptions of the preferred embodiments will occur to those skilled in the art. Such modifications and adaptations are within the spirit and scope of the present invention.

What is claimed is:

1. A method for processing a music waveform comprising the steps of:

sampling said music waveform at intervals of time to produce a music waveform sequence of numerical representations of the waveform, $\{x_j\}$ for $j=0, \ldots i$, where i represents the current sample of the waveform and 0, 1, 2 . . . represent previous time samples of the waveform, determining the auto-correlation values of said sequence $\{x_j\}$ at lag values zero and L, and determining the smallest value of L which minimizes the difference between the auto-correlation at lag zero and the auto-correlation at lag L, whereby said smallest value of L represents the measured period of said music waveform.

2. The method of claim 1 further comprising the step of retuning said music waveform sequence by changing its period by an amount equal to the difference between said measured period of said music waveform and the period of a note from a musical scale that is closest to said measured period to produce a retuned music waveform sequence.

3. The method of claim 2 further comprising the step of retuning said music waveform sequence by changing its period by an amount equal to the difference between said measured period of said music waveform and the period from a MIDI interface to produce a retuned music waveform sequence.

4. The method of claim 1 further comprising the step of determining said auto-correlation value by E and H functions, $$E_i(L) = \sum_{j=0}^{2L} x_j^2, \text{ and}$$

$$H_i(L) = \sum_{j=0}^{L} x_j x_{j-L}$$

which are determined within two cycles of said waveform.

5. A method for processing a music waveform comprising the steps of, sampling said music waveform at intervals of time to produce a sequence of musical representations at a sample rate of the waveform, $\{x_j\}$ for j=0, 1, 2, . . . i, where i represents the current sample at a current sample rate of the waveform and j=1, j=2 . . . represent prior time samples of the waveform, providing an estimate of lag value $L_{est}$ of the period of the music waveform, updating two functions representative of the accumulated energy of the waveform over two periods 2L of the waveform, using $$E_i(L)=E_{i-1}(L)+x^2_i-x_{i-2L}^2,$$

$$H_i(L)=H_{i-1}(L)+x_i x_{i-L}-x_{i-L}x_{i-2L}, \text{ and}$$

selecting that lag value of L as the period of the music waveform that minimizes the difference between $E_i(L)$ and $2H_i(L)$.

6. The method of claim 5 wherein said value of L which minimizes the function $V=E_i(L)-2H_i(L)$ is defined as $L_{min\ est}$, and said method further comprising the steps of, determining three values, $V_1$, $V_2$, $V_3$ of said function about $L_{min\ est}$, $$V_1=E(L_{min\ est}-1)-2H(L_{min\ est}-1),$$

$$V_2=E(L_{min})-2H(L_{min\ est}), \text{ and}$$

$$V_3=E(L_{min\ est}+1)-2H(L_{min\ est}+1),$$

fitting a quadratic curve to said values $V_1$, $V_2$, $V_3$ as a function of $L_{min\ est}$, and determining a value $L_{min\ est}$ at a minimum of said quadratic curve.

7. The method of claim 5 further comprising the step of retuning said music waveform sequence by changing its period by an amount equal to the difference between said measured period of said music waveform and the period of a note from a musical scale that is closest to said measured period to produce a retuned music waveform sequence.

8. The method of claim 5 further comprising the step of retuning said music waveform sequence by changing its period by an amount equal to the difference between said measured period of said music waveform and the period from a MIDI interface to produce a retuned music waveform sequence.

9. The method of claim 8 further comprising the step of retuning said music waveform sequence by gradually changing said sample rate to a new sample rate which will convert the period L to said period of a note from a musical scale.

10. The method of claim 8 further comprising the step of, retuning said music waveform sequence by gradually changing said sample rate to a new sample rate which will convert the period L to said period from said MIDI interface.

11. The method of claim 7 further comprising the step of converting said returned waveform sequence into a retuned analog music signal.

12. The method of claim 8 further comprising the step of converting said returned waveform sequence into a retuned analog music signal.

13. The method of claim 5 further comprising the step of, first applying said sequence $\{x_j\}$ for j=0, 1, 2 . . . i, to an 8 to 1 anti-aliasing filter, and then downsampling said sequence.

14. The method of claim 5 wherein, the variable $L_{est}$ is computed from N to 1 downsampled data.

15. The method of claim 14 wherein,

N is the number 8.

16. The method of claim 5 wherein, the variable $L_{est}$ is computed from $E_i(L)$ and $H_i(L)$ over a wide range of the lag variable L using downsampled data.

17. The method of claim 5 wherein, said sequence is downsampled by a rate of eight to one to produce a downsampled sequence, providing said lag value estimate $L_{est}$ of the period of said downsampled sequence, and wherein periodicity of said waveform is determined by the step of, varying the parameter L, and selecting a particular value of L as the period of said waveform which minimizes the relationship, $$E_i(L)-2H_i(L) \leqq \text{eps } E_i(L),$$

where eps is a small number.

18. The method of claim 17 further comprising the step of, determining a second value of L which minimizes said function, $$E_i(L)-2H_i(L) \leqq \text{eps } E_i(L)$$

so as to identify a missing fundamental frequency of said waveform.

19. The method of claim 5 wherein, said steps for processing a music waveform to determine the period of said waveform are performed in a programmed digital processor during background processing.

20. Apparatus for processing a music waveform comprising, means for sampling said music waveform at intervals of time to produce a music waveform sequence of numerical representations of the waveform, $\{x_j\}$ for $j=0, \ldots i$, where i represents the current sample of the waveform and 0,1,2 . . . represent previous time samples of the waveform, means for determining the auto-correlation values of said sequence $\{x_j\}$ at lag values zero and L, and means for determining the smallest value of L which minimizes the difference between the auto-correlation at lag zero and the auto-correlation at lag L, whereby said smallest value of L represents the measured period of said music waveform.

21. The apparatus of claim 20 further comprising, means for retuning said music waveform sequence by changing its period by an amount equal to the difference between said measured period of said music waveform and the period of a note from a musical scale that is closest to said measured period to produce a returned music waveform sequence.

22. The apparatus of claim 21 further comprising, means for retuning said music waveform sequence by changing its period by an amount equal to the difference between said measured period of said music waveform and the period from a MIDI interface to produce a retuned music waveform sequence.

23. The apparatus of claim 20 further comprising, means for determining said auto-correlation value by E and H functions, $$E_i(L) = \sum_{j=0}^{2L} x_j^2, \text{ and}$$

$$H_i(L) = \sum_{j=0}^{L} x_j x_{j-L}$$

which are determined within two cycles of said waveform.

24. Apparatus for processing a music waveform comprising, means for sampling said music waveform at intervals of time to produce a sequence of musical representations at a sample rate of the waveform, $\{x_j\}$ for j=0, 1, 2, . . . i, where i represents the current sample at a current sample rate of the waveform and j=1, j=2 . . . represent prior time samples of the waveform, means for providing an estimate of lag value $L_{est}$ of the period of the music waveform, means for updating two functions representative of the accumulated energy of the waveform over two periods 2L of the waveform, using $$E_i(L)=E_{i-1}(L)+x_i^2 x_{i-2L}^2,$$

$$H_i(L)=H_{i-1}(L)+x_i x_{i-L}-x_{i-L} x_{i-2L}, \text{ and}$$

means for selecting that lag value of L as the period of the music waveform that minimizes the difference between $E_i(L)$ and $2H_i(L)$.

25. The apparatus of claim 24 wherein, said value of L which minimizes the function $V=E_i(L)-2H_i(L)$ is defined as $L_{min\ est}$, and said apparatus further includes, means for determining three values, $V_1$, $V_2$, $V_3$ of said function about $L_{min\ est}$, $$V_1=E(L_{min\ est}-1)-2H(L_{min\ est}-1),$$

$$V_2=E(L_{min\ est})-2H(L_{min\ est}), \text{ and}$$

$$V_3=E(L_{min\ est}+1)-2H(L_{min\ est}+1),$$

means for fitting a quadratic curve to said values $V_1$, $V_2$, $V_3$ as a function of $L_{min\ est}$, and means for determining a value $L_{min\ est}$ at a minimum of said quadratic curve.

26. The apparatus of claim 24 further comprising, means for retuning said music waveform sequence by changing its period by an amount equal to the difference between said measured period of said music waveform and the period of a note from a musical scale that is closest to said measured period to produce a retuned music waveform sequence.

27. The apparatus of claim 24 further comprising, means for retuning said music waveform sequence by changing its period by an amount equal to the difference between said measured period of said music waveform and the period from a MIDI interface to produce a retuned music waveform sequence.

28. The apparatus of claim 27 further comprising, means for retuning said music waveform sequence by gradually changing said sample rate to a new sample rate which will convert the period L to said period of a note from a musical scale.

29. The apparatus of claim 27 further comprising, means for retuning said music waveform sequence by gradually changing said sample rate to a new sample rate which will convert the period L to said period from said MIDI interface.

30. The apparatus of claim 26 further comprising, means for converting said returned waveform sequence into a retuned analog music signal.

31. The apparatus of claim 27 further comprising, means for converting said retuned waveform sequence into a retuned analog music signal.

32. The apparatus of claim 24 further comprising, means for first applying said sequence {x} for j=0, 1, 2 . . . i, to an 8 to 1 anti-aliasing filter, and means for subsequently downsampling said sequence.

33. The apparatus of claim 24 wherein, the variable $L_{est}$ is computed from N to 1 downsampled data.

34. The apparatus of claim 33 wherein,

N is the number 8.

35. The apparatus of claim 24 wherein, the variable $L_{est}$ is computed from $E_i(L)$ and $H_i(L)$ over a wide range of the lag variable L using downsampled data.

36. The apparatus of claim 24 further comprising, means for downsampling said sequence by a rate of eight to one to produce a downsampled sequence.

37. The apparatus of claim 36 further comprising, means for determining a second value of L which minimizes said function, $$E_i(L)-2H_i(L) \leq \text{eps } E_i(L)$$

so as to identify a missing fundamental frequency of said waveform.

38. The apparatus of claim 24 further comprising, means for processing said music waveform to determine the period of said waveform in a programmed digital processor during background processing.

* * * * *